US008483401B2

(12) United States Patent
Sampimon et al.

(10) Patent No.: US 8,483,401 B2
(45) **Date of Patent: *Jul. 9, 2013**

(54) WIRED NOISE CANCELLING STEREO HEADSET WITH SEPARATE CONTROL BOX

(75) Inventors: Gerrit Johannes Willem Sampimon, Erm (NL); Johannes Lucas Schreuder, Ees (NL)

(73) Assignee: Plantronics, Inc., Santa Cruz, CA (US)

( * ) Notice: Subject to any disclaimer, the term of this patent is extended or adjusted under 35 U.S.C. 154(b) by 138 days.

This patent is subject to a terminal disclaimer.

(21) Appl. No.: 13/036,680

(22) Filed: Feb. 28, 2011

(65) Prior Publication Data

US 2012/0087510 A1 Apr. 12, 2012

Related U.S. Application Data

(60) Provisional application No. 61/391,363, filed on Oct. 8, 2010.

(51) Int. Cl.
*H04R 1/10* (2006.01)

(52) U.S. Cl.
USPC ..... 381/74

(58) Field of Classification Search
USPC ..... 381/74
See application file for complete search history.

(56) References Cited

U.S. PATENT DOCUMENTS 5,982,904 A * 11/1999 Eghtesadi et al. ..... 381/74
6,055,312 A 4/2000 Pralus et al.
7,187,948 B2 3/2007 Alden
D630,186 S 1/2011 Yang
8,094,859 B2 * 1/2012 Suematsu et al. ..... 381/384
2001/0049262 A1 12/2001 Lehtonen
2003/0129978 A1 * 7/2003 Akiyama et al. ..... 455/426
2005/0195988 A1 * 9/2005 Tashev et al. ..... 381/92
2007/0076897 A1 4/2007 Philipp
2007/0098192 A1 * 5/2007 Sipkema ..... 381/312
2007/0287380 A1 * 12/2007 Hui et al. ..... 455/41.1

(Continued)

OTHER PUBLICATIONS

PCT International Search Report, mailed Sep. 30, 2011, in connection with International Application No. PCT/NL2011/050459.

(Continued)

*Primary Examiner* — Brian Ensey
*Assistant Examiner* — Katherine Faley
(74) *Attorney, Agent, or Firm* — Kenneth B. Leffler

(57) ABSTRACT

A noise-cancellation wired headset device has a left ear piece, a right ear piece, a control box, first and second cables, and a connector for connecting the control box to a third cable. Each of the ear pieces comprises its own speaker, microphone and battery. The control box includes circuitry including noise cancellation circuitry and a power management unit. The left ear piece battery is connected to supply power to the power management unit by means of the first cable; and the right ear piece battery is connected to supply power to the power management unit by means of the second cable. The power management unit in the control box regulates the supplied battery power and supplies regulated power to control box circuitry. The noise cancellation circuitry is for noise cancellation processing of signals provided by the first and second microphones.

18 Claims, 9 Drawing Sheets

U.S. PATENT DOCUMENTS

2008/0144540 A1* 6/2008 Chang et al. ..... 370/278
2008/0186241 A1* 8/2008 Christensen ..... 343/718
2008/0311966 A1 12/2008 Klein
2008/0317105 A1 12/2008 Cohen et al.
2010/0273441 A1* 10/2010 Dubash et al. ..... 455/192.2
2011/0019859 A1* 1/2011 Van Der Beek et al. ..... 381/375
2011/0116675 A1* 5/2011 Terlizzi et al. ..... 381/384
2011/0317844 A1* 12/2011 Schreuder et al. ..... 381/71.6
2012/0052810 A1* 3/2012 Schreuder et al. ..... 455/41.3
2012/0093334 A1* 4/2012 Schreuder et al. ..... 381/74
2012/0189136 A1* 7/2012 Brown et al. ..... 381/74

OTHER PUBLICATIONS

PCT Written Opinion, mailed Sep. 30, 2011, in connection with International Application No. PCT/NL2011/050459.
Motorola Bluetooth Active Headphones S9 MotoManual, Manual No. 6809507A77-0 Motorola, Inc., 2007.
Plantronics BackBeat 903/906 User Guide, 81378-03 Rev. B, Plantronics B.V., 2009.

* cited by examiner

100

400

500

WIRED NOISE CANCELLING STEREO HEADSET WITH SEPARATE CONTROL BOX

CROSS REFERENCE TO RELATED APPLICATIONS

This application claims the benefit of U.S. Provisional Application No. 61/391,363, filed Oct. 21, 2010, which is hereby incorporated herein by reference in its entirety.

BACKGROUND

The present invention relates generally to electronic devices, such as electronic devices for engaging in voice communications and music listening. More particularly, the invention relates to a wired headset with noise cancellation capabilities.

Mobile and/or wireless items of electronic devices are becoming increasingly popular and are in widespread use. In addition, the features associated with certain types of electronic devices have become increasingly diverse. To name just a few of many possible examples, electronic device functionality includes picture-taking ability, text messaging capability, Internet browsing functionality, electronic mail capability, video playback capability, audio playback capability, image display capability, and navigation capability.

Electronic devices, such as digital music players (e.g., those capable of reproducing audio output from mp3 or other format files), mobile (smart) phones, and portable Personal Computers like netbooks and laptops have become a significant part of many people's everyday experiences. To make these experiences as pleasing as possible, it is desirable that the electronic devices be easy to use. The user experience of these electronic devices is enhanced considerably by headsets that allow the user to freely listen to prerecorded music, listen to FM radio stations, or to engage in voice communications.

Wired voice headsets are used extensively to interact with mobile phones. When buying a phone, it is standard for a wired headset to be included in the box with the phone. With the increased use of the mobile phone for music delivery as well, wired stereo headsets that can support both voice calls and stereo music listening have become quite popular. A few of these stereo headsets even have a built-in FM radio.

Wired stereo headsets are also used in conjunction with portable music players (e.g., Walkman, iPod, and other (MP3) players) and with portable video players (e.g., iPod Touch).

For further audio improvement, noise suppression and noise cancellation techniques can be added to the headsets. These types of headsets used to be made for travelers, in particular for air travel, in order to suppress the environmental noise. Noise cancellation headsets that are presently available are rather bulky, and differ considerably from the lean and light-weight wired headsets delivered with mobile phones and MP3 music players. Present-day wired stereo headsets with noise cancellation do not offer form factors that make them easily wearable. Improved designs are therefore desirable.

SUMMARY

It should be emphasized that the terms "comprises" and "comprising", when used in this specification, are taken to specify the presence of stated features, integers, steps or components; but the use of these terms does not preclude the presence or addition of one or more other features, integers, steps components or groups thereof.

In accordance with one aspect of embodiments consistent with the invention, the foregoing and other objects are achieved in a wired headset device comprising: a first ear piece comprising a first speaker and a first microphone; a second ear piece comprising a second speaker and a second microphone; a control box comprising control box circuitry; a first cable between the control box and the first ear piece; a second cable between the control box and the second ear piece; and a connector for connecting the control box to a third cable, wherein the third cable is for connecting the control box to a phone or media player. The first ear piece can be, for example, a left ear piece. The control box circuitry comprises noise cancellation circuitry and a power management unit. The noise cancellation circuitry is for noise cancellation processing of signals provided by the first and second microphones. The first ear piece further comprises a first battery connected to supply power to the power management unit by means of the first cable.

In some embodiments, the second ear piece further comprises a second battery connected to supply power to the power management unit by means of the second cable. In some embodiments, the batteries in the first and second ear pieces are electrically connected in parallel. In some embodiments, the control box comprises a third battery connected to supply power to at least a portion of circuitry within the wireless headset device.

In some embodiments, the control box circuitry comprises an FM radio. In some but not necessarily all of such embodiments, the first and second cables are configured to be used together as an antenna for the FM radio. In some but not necessarily all of such embodiments, one of the first or second cables is isolated from the control box ground with respect to radiofrequency signals.

In some embodiments, the control box comprises a microphone configured to supply microphone output signals to a host device.

In an aspect of some embodiments, the first cable comprises a first pair of wires coupled to convey power from the first battery to the power management unit; the first cable comprises a second pair of wires coupled to carry analog audio signals between the first speaker and the control box circuitry; and the first cable comprises a third pair of wires coupled to carry analog audio signals between the first microphone and the control box circuitry.

In an aspect of some embodiments, the second cable comprises a first pair of wires coupled to convey power from the second battery to the power management unit; the second cable comprises a second pair of wires coupled to carry analog audio signals between the second speaker and the control box circuitry; and the second cable comprises a third pair of wires coupled to carry analog audio signals between the second microphone and the control box circuitry.

In an aspect of some alternative embodiments, the first cable comprises two wires for supplying the power from the first battery to the power management unit; and the device comprises circuitry for communicating a first channel of two-channel audio information in digital form from the control box circuitry to circuitry in the first ear piece via the two wires in the first cable.

In an aspect of some alternative embodiments, the second ear piece further comprises a second battery connected supply power to the power management unit by means of the second cable; the second cable comprises two wires for supplying the power from the second battery to the power management unit; and the device comprises circuitry for communicating a second channel of the two-channel audio information in digital form from the control box circuitry to circuitry in the second ear piece via the two wires in the second cable.

In some but not necessarily all embodiments in which both the left and right ear pieces receive audio information in digital form as described above, the first and second channels of the two-channel audio information are time multiplexed when communicated via the first and second cables to the respective first and second ear pieces.

In some embodiments, the first microphone is for generating a first microphone signal from sensed acoustic energy; the second microphone is for generating a second microphone signal from sensed acoustic energy; and the noise cancellation circuitry comprises beam-forming circuitry coupled to receive the first and second microphone signals and adapted to constructively combine components of the first and second microphone signals that are associated with a source of acoustic energy, and to destructively combine all other components of the first and second microphone signals.

In some embodiments, the device comprises a short-range radio in the control box, wherein the short-range radio is for wireless communication between the device and the phone or media player.

In some embodiments, the connector is adapted to provide for removable connection to the third cable.

In some embodiments in which the device comprises the short-range radio and the connector is adapted to provide for removable connection to the third cable, the device comprises circuitry configured to activate the short-range radio in response to the third cable being disconnected from the control box.

In some embodiments, the first ear piece comprises an ear bud and a disk, wherein the ear bud is adapted to fit inside an ear and the disk is adapted to be located outside the ear when the ear bud is inside the ear; the first battery is located in the disk; and the speaker is located in the ear bud.

In some embodiments, the first ear piece comprises an ear bud and a disk, wherein the ear bud is adapted to fit inside an ear and the disk is adapted to be located outside the ear when the ear bud is inside the ear; the first battery is located in the disk; the speaker is located in the disk; and the ear bud comprises a tube for carrying an audio signal from the speaker into an ear canal of the ear.

BRIEF DESCRIPTION OF THE DRAWINGS

Many aspects of the invention can be better understood with reference to the following drawings. The components in the drawings are not necessarily to scale, emphasis instead being placed upon clear illustration of the principles of the present invention. Likewise, elements and features depicted in one drawing may be combined with elements and features depicted in additional drawings. Moreover, in the drawings, like reference numerals designate corresponding parts throughout the several views.

DETAILED DESCRIPTION

The various aspects of the invention will now be described in detail in connection with a number of exemplary embodiments. To facilitate an understanding of the invention, some aspects of the invention may be described in terms of sequences of actions to be performed by elements of a computer system or other hardware capable of executing programmed instructions. It will be recognized that in each of the embodiments, the various actions could be performed by specialized circuits (e.g., analog and/or discrete logic gates interconnected to perform a specialized function), by one or more processors programmed with a suitable set of instructions, or by a combination of both. The term "circuitry configured to" perform one or more described actions is used herein to refer to any such embodiment (i.e., one or more specialized circuits and/or one or more programmed processors). Moreover, the invention can additionally be considered to be embodied entirely within any form of computer readable carrier, such as solid-state memory, magnetic disk, or optical disk containing an appropriate set of computer instructions that would cause a processor to carry out the techniques described herein. Thus, the various aspects of the invention may be embodied in many different forms, and all such forms are contemplated to be within the scope of the invention. For each of the various aspects of the invention, any such form of embodiments as described above may be referred to herein as "logic configured to" perform a described action, or alternatively as "logic that" performs a described action.

In the present document, embodiments are described primarily in the context of a portable radio communications device, such as an illustrated mobile telephone. It will be appreciated, however, that the exemplary context of a mobile telephone is not the only operational environment in which aspects of the disclosed systems and methods may be used. Therefore, the techniques described in this document may be applied to any type of appropriate electronic host device, examples of which include a mobile telephone, a media player, a gaming device, a computer, a pager, a communicator, an electronic organizer, a personal digital assistant (PDA), a smart phone, a portable communication apparatus, remote display device, etc.

Figure 1:
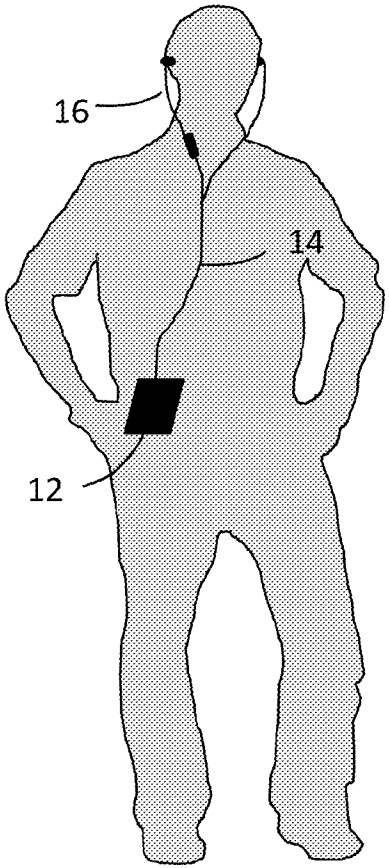
FIG. 1 is a schematic diagram of an exemplary use scenario of a particular user using a host device like a music player and a wired headset.

Electronic devices, such as portable music players, portable video players, and mobile phones, are in widespread use throughout the world. Although the mobile phone was developed for providing wireless voice communications, its capabilities have been increased tremendously. Modern (smart) phones can access the worldwide web, store a large amount of video and music content, include a lot of applications ("apps") that enhance the phone's capabilities, provide an interface for social networking, and can even receive FM radio channels. Preferably, a phone, music player (e.g. iPod), or video player (e.g. iPod Touch) has a large screen with touch capabilities for easy user interaction. However, having a large screen makes the device less attractive for any interaction involving the user's ears, such as voice communications and listening to music. For those applications, the device is sold with a wired headset with which the user can enjoy the audio (e.g., music, audio books), and in some instances also voice, applications. Furthermore, the user can interact with the touch screen or buttons on the host device while simultaneously carrying on a voice call or listening to music. An example of such a user scenario 100 is shown in FIG. 1. Host device 12 is a device that contains audio content which it can stream over a wired connection 14 to a headset 16.

Figure 2:
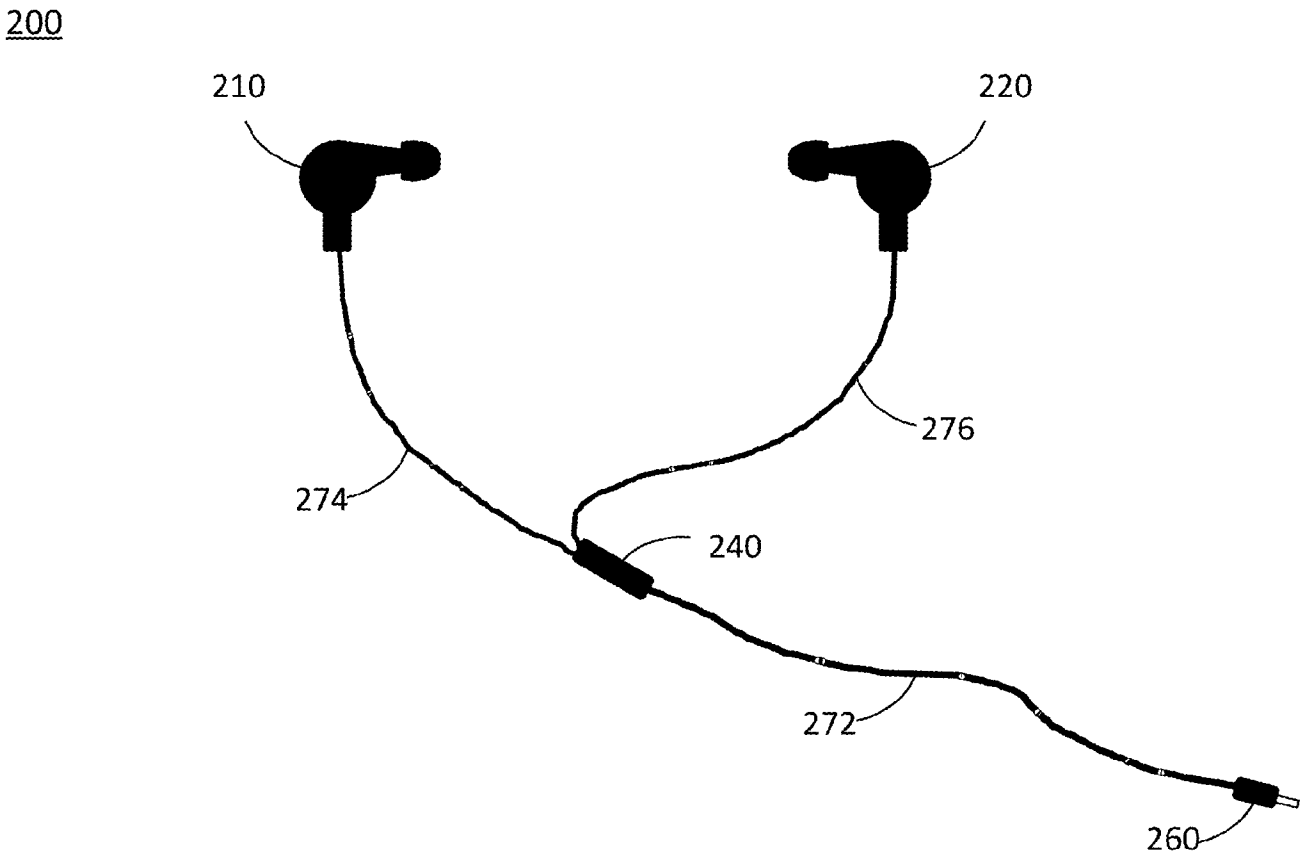
FIG. 2 is a schematic diagram of a wired headset according to aspects of the invention.

In FIG. 2, a standard wired headset embodiment 200 is shown. The displayed headset combines a number of elements that provide the audio functionality:

- Left and right ear pieces 210 and 220, respectively, each containing a speaker for stereo audio rendering.
- A control box 240 that may contain buttons (e.g. switches for controlling stop, next/previous, skip, and volume control functions) and possibly a microphone for voice pick-up (including a call accept button).
- A connector 260 connecting the wired headset to the host device. This connector can be a standard 3.5 mm jack, a Universal Serial Bus (USB) connector, a microUSB connector, or a proprietary connector unique for the host device.
- Cables 272, 274 and 276 containing one or more wires that join the elements of the headset 200.

The headset embodiment 200 is a passive device. Audio signals are provided by the host device via the connector 260 and are delivered to the speakers in the ear pieces 210 and 220.

Figure 3:
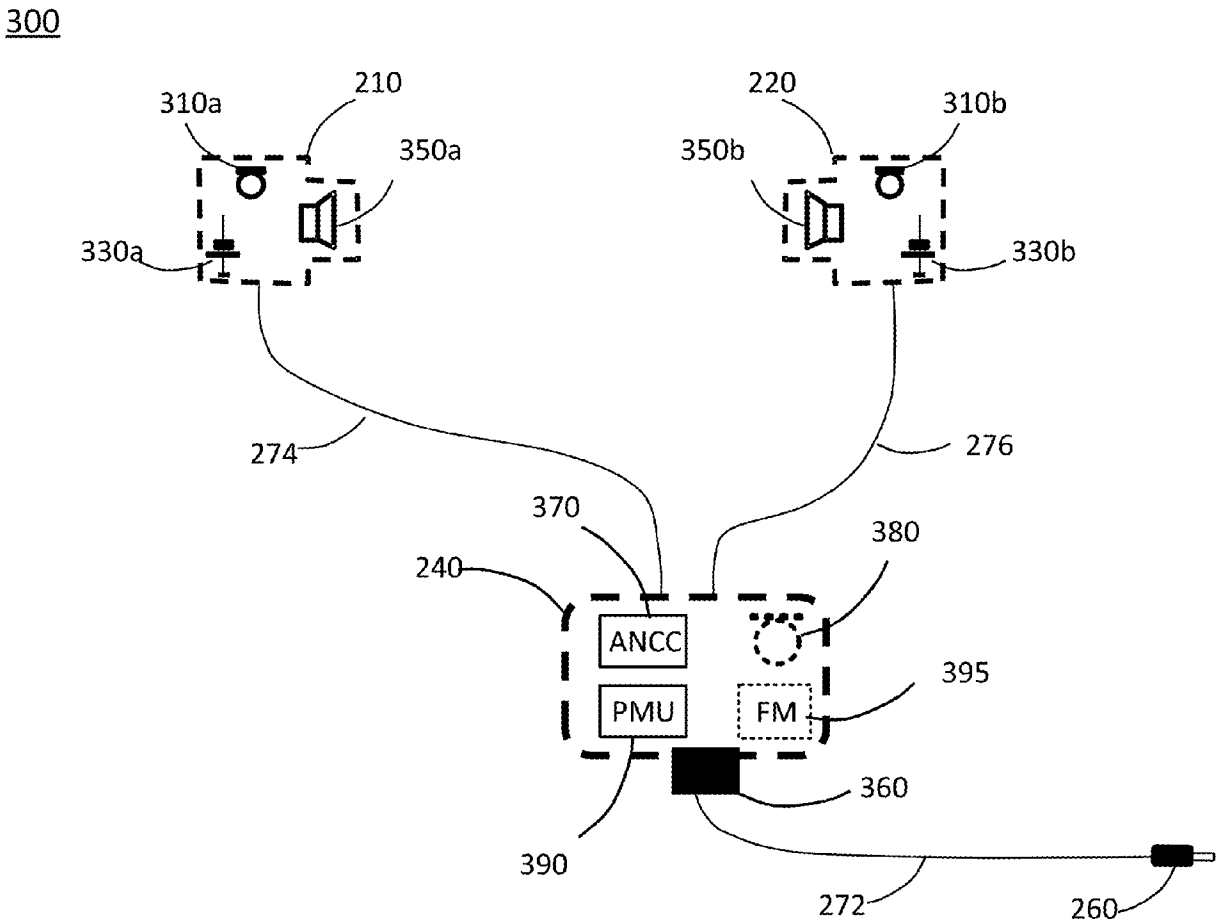
FIG. 3 is a detailed schematic diagram of a first embodiment consistent with aspects of the invention.

FIG. 3 shows a detailed block schematic 300 of a stereo wired headset including noise cancellation. The ear pieces 210, 220 each contain, respectively, a microphone 310*a*, 310*b*; a battery 330*a*, 330*b*; and a speaker 350*a*, 350*b*. The microphone signals are used for noise cancellation. The control box 240 contains analog noise cancellation circuitry (ANCC) 370 in addition to other means for providing the functionality (e.g., buttons) as found in wired headset 200. In some embodiments, the control box 240 also contains a microphone 380 for voice pick-up (depicted by dotted lines to illustrate the optional placement of these components). In alternative embodiments, voice pick-up may be carried out by the microphones 310*a*, 310*b* as will be discussed later. A Power Management Unit (PMU) 390 is added to provide stable voltage and current supplies for all electronic circuitry. The control box 240 also contains a connector 360 that serves as an interface between control box circuitry and the cable 272. Preferably, the connector 360 allows for removable connection to the cable 272, but this is not a requirement in all embodiments. It is advantageous for the connector 360 to be a USB connector or equivalent. This USB connector 360 can be used for charging the batteries 330*a*, 330*b*, and can be used to fit different cables 272 that connect to different host devices. In some alternative embodiments, the cable 272 is not removable from the connector 360, in which case the connector 360 is an interface between control box circuitry and the cable 272. The interface may involve one or more circuit elements, or may simply comprise one or more connection points between wires.

In some but not necessarily all embodiments, an FM radio receiver 395 is included in control box 240.

Analog stereo audio signals are provided from the host device 12 to control box 240 via cable 272. Analog audio signals picked up by the microphones 310*a*, 310*b* are provided to control box 240 via cables 274, 276. The analog input signals are processed by the analog noise cancellation circuitry 370, and suitable analog output signals are produced that are delivered to respective speakers 350*a*, 350*b*. The output signals are such that the combined experience of the audio signals and the noise entering the user's ear canal is heard as audio without environmental noise.

Figure 4:
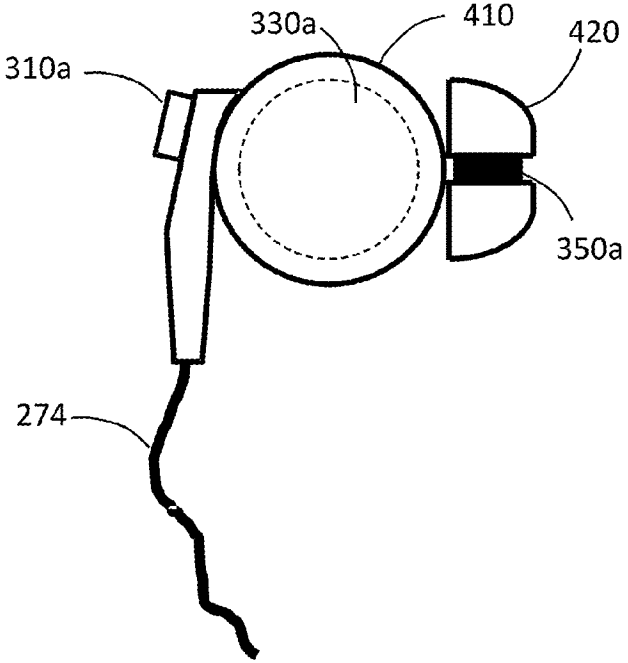
FIG. 4 is an example of an ear piece embodiment consistent with embodiments of the invention.

Noise cancellation is most effective with ear pieces (shells) that cover the entire ear and thus provide isolation between the ear and the environment. However, for small ear pieces that are worn inside the ear rather than over the ear, noise cancellation is most effective when in-ear speakers are used. In this case, an ear bud is used that is located within the ear canal of the user (also called inner-ear channel wearing). The speaker is preferably located in the ear bud. Alternatively, the ear bud contains a tube for carrying the audio signals from the speaker directly into the ear canal—the speaker can then be located in a position outside the ear (not shown). It is desirable for the ear buds to be tight fitting, so that a first level of isolation between the environmental noise and the ear canal is achieved. An example of an in-ear ear piece 400 is shown in FIG. 4. The exemplary in-ear piece 400 is a left ear piece, but it will be readily appreciated that a right ear piece can be similarly arranged. The battery 330*a* is placed outside the ear in disk 410. The in-ear speaker 350*a* is preferably located in ear bud 420 to provide the biggest space for battery 330*a* in the disk 410. However, the speaker 350*a* could alternatively be located in the disk 410, with a small tube being used in the ear bud 420 to carry the audio signal from the speaker into the ear canal. The microphone 310*a* for noise cancellation is placed at a location on ear piece 400 outside the ear.

Figure 5:
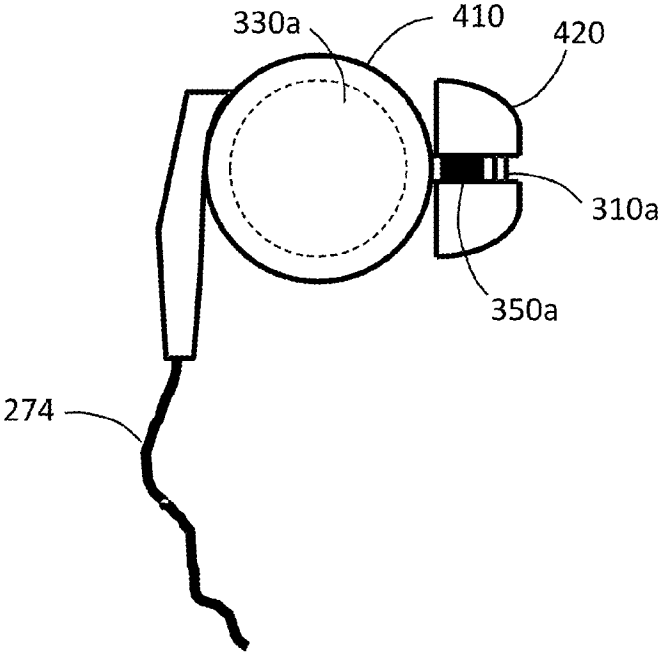
FIG. 5 is another example of an ear piece embodiment consistent with embodiments of the invention.

Alternatively, the microphone 310*a* can be placed in the ear, as is depicted in FIG. 5. (Again, a left earpiece is illustrated, but it will be readily appreciated that a right earpiece will be similarly arranged.) In yet another alternative embodiment (not shown), the microphone 310*a* and/or speaker 350*a* is not physically located inside the ear canal, but is in direct contact with the air pressure inside the ear canal via a tube. If the microphone 310*a* is placed inside the ear, the noise cancellation algorithm can make use of feed-back methods. The audio (e.g., music) signal played in the ear is picked up by the microphone 310*a* and, in circuitry 370, is compared with the original audio signal delivered to the speaker. Any deviation is deemed to be noise that can be cancelled by using known noise cancelation techniques that rely on this feedback. The deviation is used to generate a correction signal that is used to adjust the signal provided to the speaker 350*a*. The noise cancellation circuitry 370 will always try to minimize the deviation.

If the microphones 310*a*, 310*b* are located at a position of the ear piece 400 outside the ear canal, such as is shown in FIG. 4, feed-forward methods must be used. The (fixed) acoustical path from between the microphone 310*a* and the speaker 350*a* is used in analog noise cancellation circuitry 370 to generate a correction signal that will reduce the impact of the environmental noise experienced in the ear canal.

All power for the noise cancellation is delivered by a battery (or other energy storage device), which typically provides a 3.7V voltage (this voltage is exemplary and should not be considered limiting in any way). It is advantageous for a respective one of two batteries 330*a*, 330*b* to be placed in each of the ear pieces 210 and 220. Alternatively, a single battery could be placed in only one of the ear pieces 210, 220. However, not only would this result in less playing time, this would additionally result in an unbalanced solution whereby one ear piece would be heavier than the other. The placement of batteries in the ear pieces 210, 220 instead of in control box 240 (as found in commonly available noise cancelling wired headsets) provides a more wearable solution that resembles conventional wired headsets without noise cancellation. The batteries 330*a*, 330*b* can be primary batteries or rechargeable batteries. The use of rechargeable batteries is advantageous because it provides an easy use experience. A recharging facility is provided by the (mini or micro) USB connector 360 on one side of (e.g., at the bottom of) the control box 240. Batteries 330*a*, 330*b* may have equal capacity; for example, both batteries may have a capacity of 40 mAh (this capacity is exemplary and reflects the current state-of-the-art, but should not be considered limiting in any way). Other power source allocations are possible as well, and might be better suited depending on the overall design. To take just one of many possible examples, one of the batteries can have a capacity of 30 mAh and the other can have a 50 mAh capacity if one ear piece needs more space for additional components (for example sensors) than the other. In one alternative, the placement of the two batteries is such that one battery is located in one of the ear pieces 210 or 220 and the other battery is located in the control box 240.

In yet other alternatives, more than two batteries can be used, such as but not limited to a third battery located in the control box 240 in addition to the two batteries 330*a*, 330*b* in the ear pieces. By providing total battery functionality in the form of a plurality of distinct physical batteries, a smaller overall form factor can be obtained. Alternatively, by using a plurality of distinct physical batteries, the overall power capacity can be bigger while maintaining an acceptably small size of the individual elements that house the physical batteries. For example, the size of the different elements of a headset containing two batteries of 60 mAh each in each ear piece may be more attractive than the size of the different elements of a headset containing a single battery of 80 mAh in a single ear piece or in control box 240. In the first option, the ear pieces can be smaller, yet the overall power capacity has increased as compared with the second (single battery) option. Ear pieces usually have a round form factor which is also the form factor that gives the highest energy density for batteries.

From an electrical point of view, the batteries (or alternative energy sources) are connected in parallel. This has the advantage of allowing an easy recharge mechanism because only a single recharging point is required. However, parallel connection of the energy sources is not an essential aspect of the invention. In alternative embodiments, the energy sources could be connected in series. In yet another alternative embodiment, means are provided for switching the energy sources from parallel connection to series connection in response to a detection that the energy source voltage has dropped below a threshold voltage (for example 2V). In normal operation, including when recharged, the energy sources are connected in parallel. However, during operation, the energy sources are discharged which will result in a decrease of the energy source voltage. For example, typical rechargeable batteries have a voltage of 4V when fully charged. During operation, the voltage slowly drops. When the voltage drops below say 2V, the product is usually turned off since all electronics require a minimum supply voltage (e.g., the PMU 390 needs a 2V input voltage to be able to provide a stable 1.8V supply voltage to the electronic circuitry). However, with the parallel-to-series connection switching means, a sensing circuit measures the energy source voltage of the parallel configuration and connects the energy sources in series when the energy source voltage drops below the threshold voltage. The combined series connection would raise the voltage entering the PMU 390 from 2V to 4V. In this way, energy source life (and therefore the operational life of the headset) is prolonged. The voltage levels stated herein serve only as examples; with other energy sources and electronic circuitry, other voltage levels could be needed. This technique can particularly be of interest when SuperCaps, GoldCaps, or other high-capacity capacitors are used as an energy source.

The batteries (or alternative energy sources) provide power to the circuitry in the control box 240. Control box 240 contains all active components: the analog noise cancellation circuitry 370, the PMU 390, and possibly an FM radio receiver 395. Since, in a preferable embodiment, the control box 240 does not contain a battery, its size can be very small, which enhances the wearability of the headset 16. The control box 240 may, in some alternative embodiments, also contain a microphone 380 for voice communications. To control the headset 16, button switching devices ("buttons") can be placed either in the control box 240 (not shown) or on the ear pieces 210, 220 (not shown). Buttons can be used to control such functions as, but not limited to, turning the wireless headset on and off, turning the noise cancellation function on or off, for volume control, for play-next-skip tracks, and so on. Instead of buttons, a touch sensitive user interface (UI) may be applied (not shown).

The cables 272, 274 and 276 contain a number of wires that carry power supply and signals. Cable 272 contains at least three wires: one left audio signal line, one right audio signal line, and one ground. A fourth wire, one microphone line, can be present in some but not necessarily all embodiments. The microphone line can carry voice signals picked up by microphone 380 to the host device; in addition, or instead, it can be used for signaling button commands (next/previous, etc). Cables 274, 276 each contain six wires: one analog audio signal line (left audio for 274 and right audio for 276), one analog audio ground, one analog microphone signal line (left MIC for 274 and right MIC for 276), one analog microphone ground, one positive battery wire, and one negative (ground) battery wire. The inventors recognize that in alternative embodiments, the number of wires per cable can be reduced. For example, the ground wires for audio, microphone, and power could all be shared, resulting in only four wires (i.e., two of the three ground wires are eliminated). This alternative embodiment has a detriment, however, in that the battery ground has too much series resistance. Consequently, glitches caused by the radio/electronic circuit would be noticeable in the audio signal. The six wire embodiment avoids this problem.

If FM radio functionality is desired in the wired headset (note that many host devices like a mobile phone already include an FM radio, making it unnecessary to include this functionality in the headset itself), cables 272, 274, or 276 may serve as the FM antenna. Proper electrical decoupling between the wires is required to obtain sufficient antenna efficiency at RF frequencies. Furthermore, impedance matching is needed where the wires connect into the control box 240 in order to achieve a proper separation between the RF signals on the one hand and the analog and power supply signals on the other hand.

Figure 6:
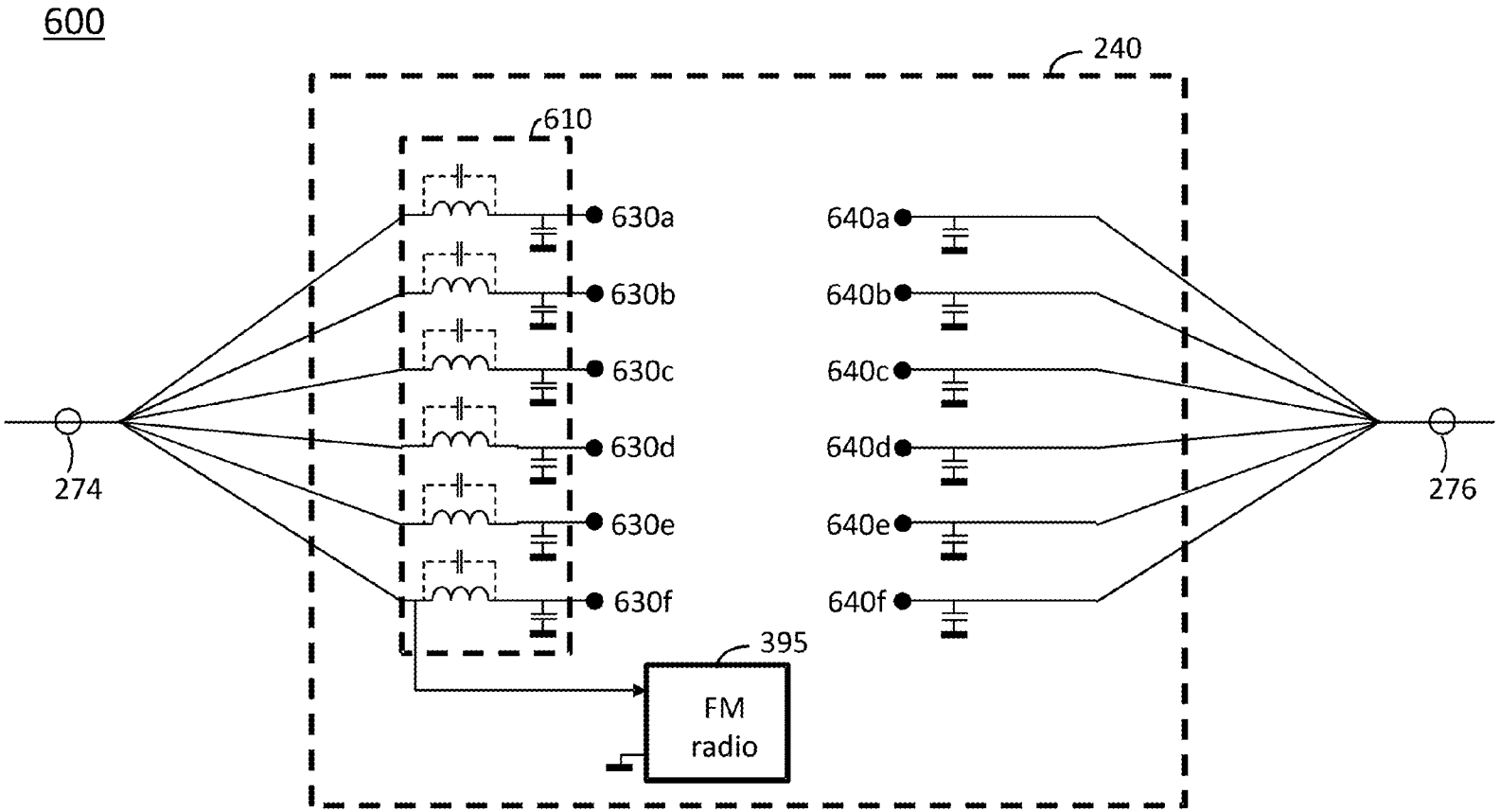
FIG. 6 is a schematic diagram illustrating an exemplary embodiment of a decoupling mechanism that can be employed in embodiments consistent with the invention.

An exemplary embodiment of decoupling circuitry 600 is depicted in the schematic diagram of FIG. 6. A dipole antenna is constructed for the FM radio 395. Cable 274 is one side of the dipole and cable 276 is the other side of the dipole. A bank of notch filters 610 is embedded in the control box 240 to suppress the FM signals picked up by cable 274. (Note that the audio and power supply signals can freely pass through this notch filter bank 610). The notch filter bank 610 provides a barrier for the FM signals (around 100 MHz). The outputs of the notch filters 630*a-f* are practically grounded for the FM signals (e.g., the ground of the printed circuit board in the control box 240). The notch filters could be implemented by a combination of a high-pass filter and a low-pass filter. The notch filter bandwidth of notch filter bank 610 is relatively wide and spans more than only the FM band ranging from 76 to 108 MHz. Therefore, in addition to suppressing FM signals, the notch filter bank 610 will also suppress signals in the high frequency (HF) and ultra-high frequency (UHF) bands. As a result, the electromagnetic compatibility (EMC) requirements on the electronic circuitry in box 240 are relaxed. The illustrated embodiment showed the dipole antenna for FM reception being formed from cables 274, 276. The wires that make up cable 276 have terminal connection points 640*a-f*.

In alternative embodiments, the dipole antenna can instead be formed from cables 272, 274; and in yet other alternative embodiments, the dipole antenna can instead be formed from cables 272, 276. In each case, only one of the cables of the pair needs to be decoupled with the notch filters as shown in FIG. 6.

Figure 7:
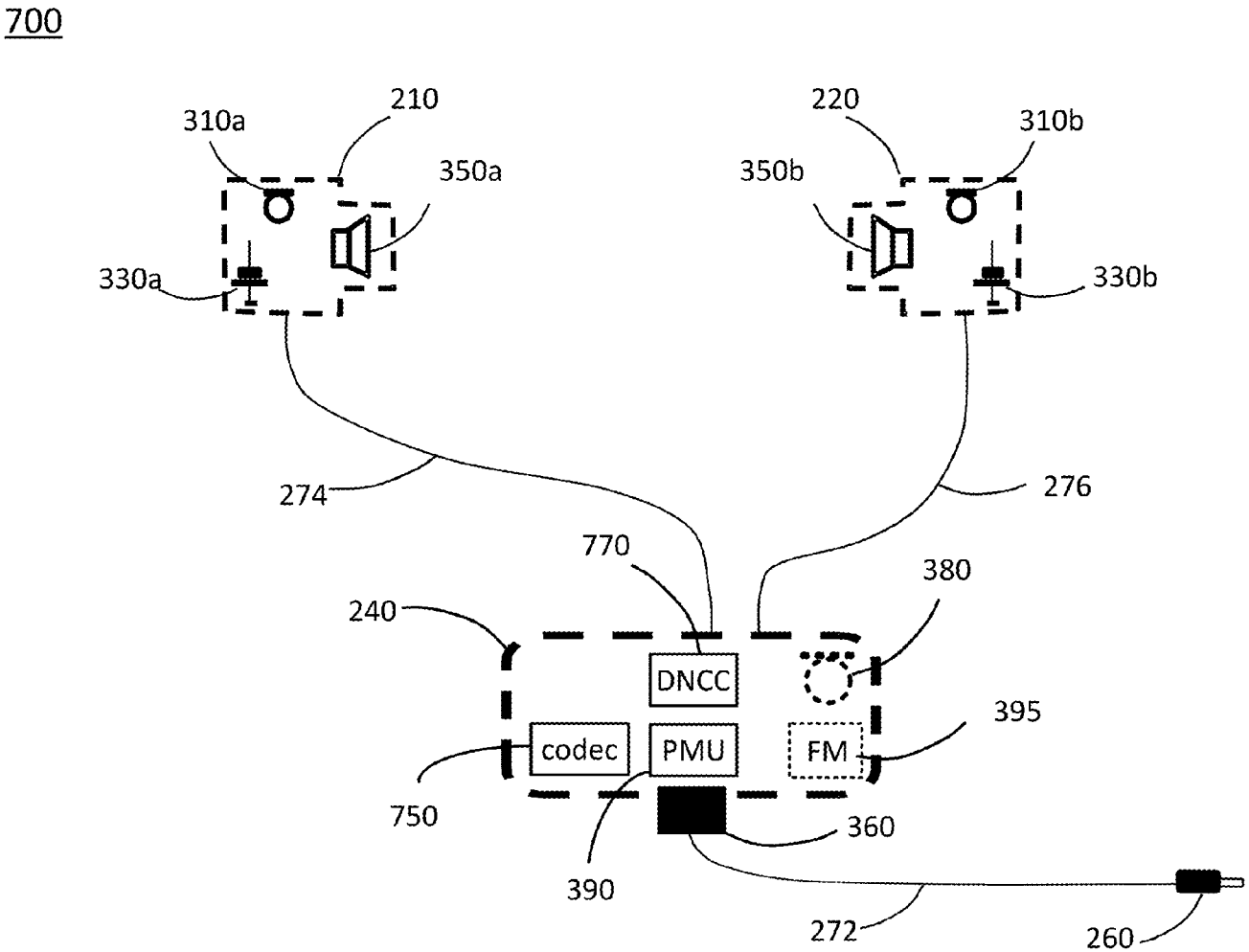
FIG. 7 is a detailed schematic diagram of a second embodiment consistent with aspects of the invention.

In another alternative embodiment 700, discussed now in connection with FIG. 7, noise cancellation is carried out in the digital domain instead of the analog domain. In such embodiments, digital noise cancellation circuitry (DNCC) 770 is employed (e.g., embodied as a digital signal processor). In this case, the analog input signals from the microphones 310*a*, 310*b* need to be digitized. This can be done with analog-to-digital (A/D) converters (not shown) located in a codec 750 as is depicted in FIG. 7. The codec is preferably located in control box 240. In an alternative embodiment (not shown), A/D converters are integrated into the microphone 310*a*, 310*b* resulting in digital microphones (DMIC). PMU 390 supplies the power to codec 750. The digital audio signals at the output of the noise cancellation circuitry 770 are converted to analog signals using a digital-to-analog (D/A) converter (not shown), also located in codec 750.

Figure 8:
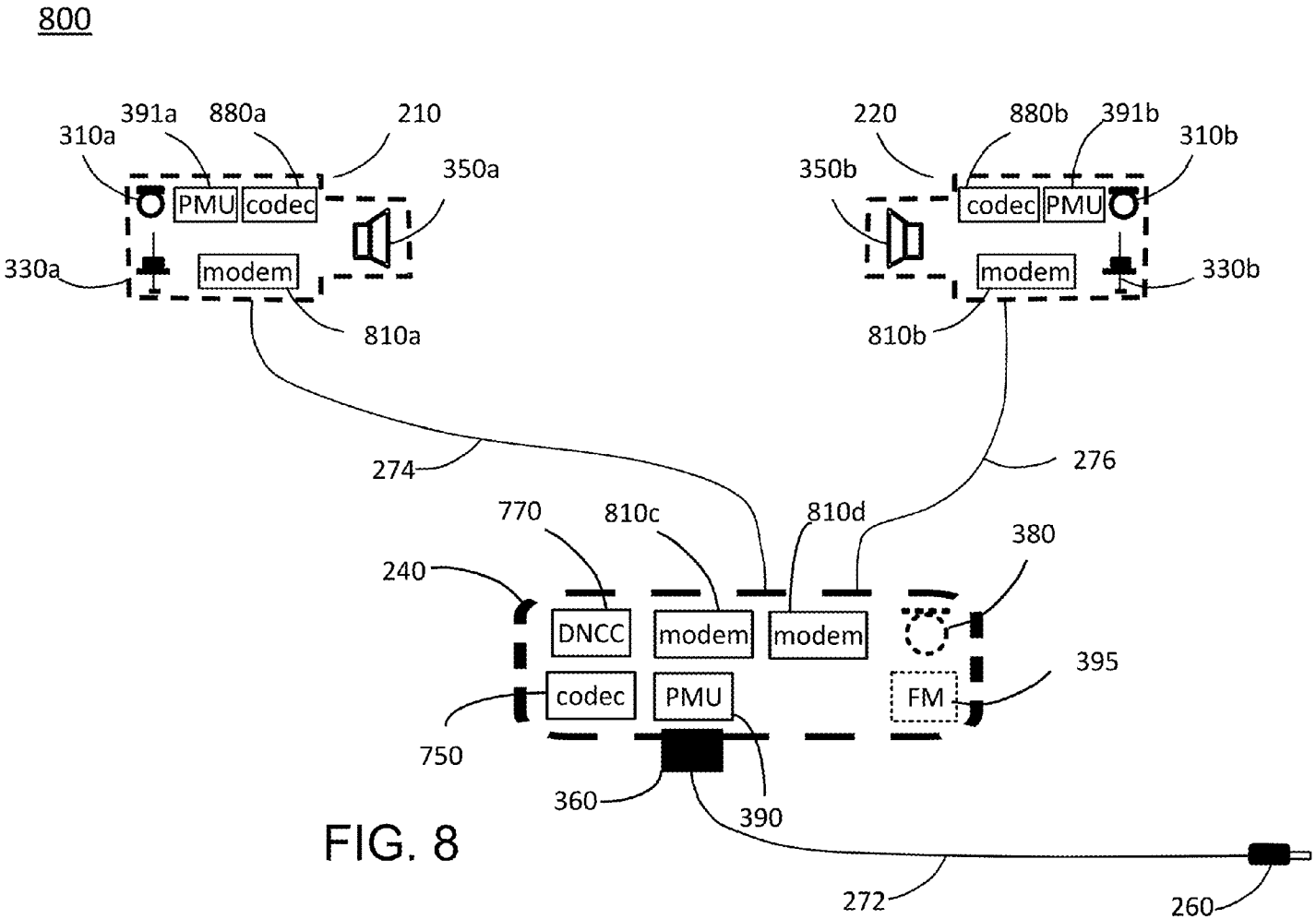
FIG. 8 is a detailed schematic diagram of a third embodiment consistent with aspects of the invention.

Using the embodiment of FIG. 7 with Digital Noise Cancellation, the number of wires in the cables 274, 276 can be further reduced. This can be achieved by replacing the signal wires carrying the analog signals to the respective speakers 350*a*, 350*b* and respective microphones 310*a*, 310*b* by a single wire for each of the left and right ear pieces, the single wire in each case being used to carry digital signals. This requires more electronic circuitry in the ear pieces as is shown in the exemplary headset 800 depicted in FIG. 8. The conversions from analog-to-digital and from digital-to-analog need to take place in the ear pieces 210, 220. Codecs 880*a*, 880*b* are present in the respective ear pieces 210, 220. In these types of embodiments, it is preferred that PMUs 391*a* and 391*b* be added to the respective ear pieces 210, 220 to provide stable voltage and current supplies to the codecs 880*a*, 880*b*. Since the signals to and from the control box 240 from and to the ear pieces are digital, digital signaling can be used and the number of wires in cables 274, 276 can be reduced to three: a positive battery wire, a negative (ground) battery wire, and a digital signal wire. The negative battery wire here serves both for the power supply ground as well as for the digital signaling ground. Respective left and right earpiece modems 810*a*, 810*b* are used to transfer the (digital) PCM audio data over the digital signal line. The modems could, for example, apply Bluetooth® baseband modulation. In the control box 240, two separate modems 810*c*, 810*d* for left and right are shown. However, in alternative embodiments a single modem may suffice since right and left information can be included in a single payload; alternatively, a time multiplexing method can be applied to separate the left and right signals. In yet other alternative embodiments, no separate signal wire is used, but the digital signals are multiplexed on the positive battery wire (with a single wire serving as both the digital signal ground and the power supply ground). In such embodiments, decoupling circuitry is needed to separate the DC power supply path from the digital signals.

The microphones 310*a*, 310*b* can also be used for voice pick-up. Far-end noise suppression (so-called because it benefits the user on the other side of the line, not the wearer of the headset, by reducing the impact of environmental noise on the voice) is achieved by the isolation of the ear canal itself in case in-ear microphones are used. For further noise suppression and voice enhancements, beam-forming can be used. In case of beam-forming, the information picked up by the left and right microphones 310*a*, 310*b* needs to be combined. The signal combining is typically carried out by a digital signal processor (DSP). Preferably, this is the same DSP as is used for the digital noise cancellation circuitry 770 in the digital domain.

Figure 9:
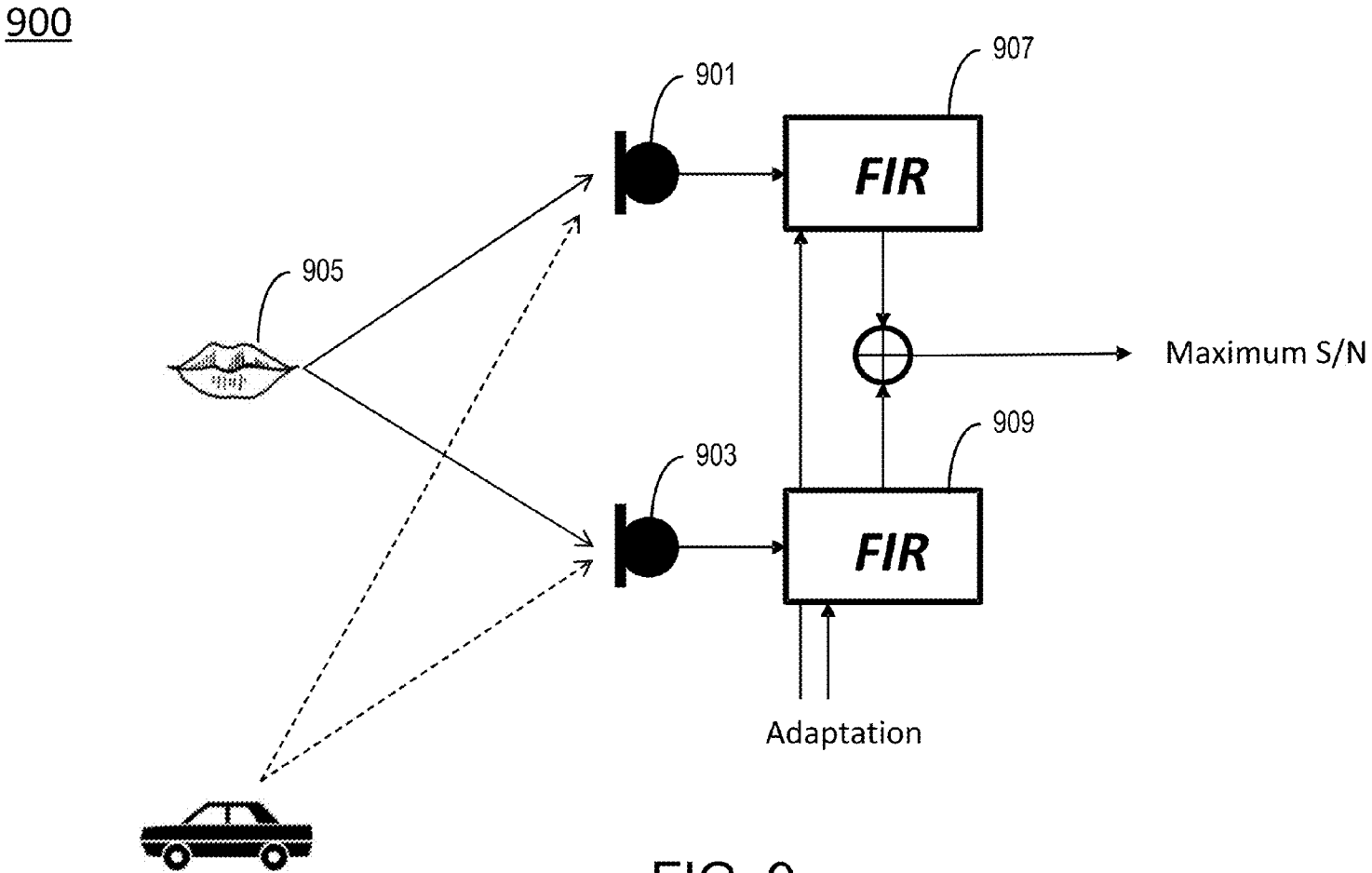
FIG. 9 illustrates beamforming concepts that can be employed in embodiments consistent with the invention.

FIG. 9 illustrates beam-forming concepts. In the exemplary arrangement 900, the acoustic signals arriving at the microphones 901, 903 are correlated. Knowledge of the phase difference between the signals originating from the same source and arriving at the microphones 901, 903 allows the signals to be combined constructively using audio filters in a processing unit. All other signals can be combined destructively so that they are suppressed as much as possible. This achieves a high differentiation between the desired signal and the undesired signals. This differentiation is commonly referred to as D-value.

The direction of the desired source (e.g., speech source 905) needs to be known in order to get the proper phase relationships. Therefore, the source needs to be identified. To achieve this, the noise-suppression algorithm is configured to include a speech detection algorithm that identifies speech. When speech is detected, an adaptation algorithm is invoked to determine the phase relation for the voice source. This phase relation is then used to enhance the voice signal in the received signals from both microphones 901, 903. The noise suppression algorithm has a presetting based on the position of the microphones 901, 903 (at the two ears in the case of the wireless headset) and the mouth. The algorithm tries to find the optimum spot of the mouth within a cone-shaped volume of space.

Each of two finite impulse response (FIR) filters 907, 909 receives signals from a respective one of the two microphones 901, 903. The FIR filters 907, 909 filter the microphone signals and provide the proper phase relationships. The FIR filter coefficients are variable. The coefficients determine both the amplitude and the phase response. An adaptive algorithm varies the coefficients such that a maximal signal-to-noise (S/N) (or signal-to-interference, S/I) ratio is achieved. In an alternative embodiment, the parameter settings of the FIR filters 907, 909 are not variable but fixed. Since the two microphones have predefined positions (one microphone at each ear position), the relative location of the mouth can be predicted. Based on this prediction, fixed parameters can be determined which are programmed in the FIR filters. This is also called Blind Source Separation (BSS).

In addition to audio functionality, the headsets shown may also include sensing capabilities. For example, the microphones placed in the ear pieces for noise cancellation may also be used for the pickup of bio-signals such as, but not limited to, heart rate or breathing rate. These signals may be forwarded from the ear pieces to the control box 240. The bio-signals can be processed by electronic circuitry in the control box 240 and/or can be communicated from the headset to an external host device (e.g., a mobile phone or a personal computer) for processing.

It will be appreciated that in various alternative embodiments, device circuitry can perform additional steps as well, such as those involved in receiving signals from the extra noise cancellation/suppression microphones (mentioned earlier) and processing those signals to cancel/suppress noise from an audio signal to be generated by one or both of the left and right speakers 350*b*, 350*a*.

Cable 272 in combination with connector 260 provides a connection from the host device 12 to the headset 16. This connection is used to stream audio music (or other audio information) from the host device 12 to the headset 16, and to support bi-directional voice communications. In addition, cable 272 and connector 260 can be used to (re-)charge the batteries in the ear pieces. If connector 260 is a USB connector, an ordinary USB charger can be used. If connector 260 is a microUSB, with USB on the go in the host device, then it is possible to provide (re-)charging while simultaneously using the headset for voice communications or music listening. Cable 272 can support analog audio signals from the host 12 to the headset 14 using a 3.5 mm audio jack for connector 260. Alternatively, cable 272 can support digital audio signals from the host 12 to the headset 14 using a (micro)USB connector for connector 260.

The described noise-cancelling headset 300 can also be used in a stand-alone mode without cable 272 to a host 12. The headset 300 can, for example, be used in noisy surroundings where the user wants to suppress environmental noise without the need for listening to music or making voice calls. In the stand-alone case, the user may also listen to FM radio channels while suppressing environmental noise, provided a built-in FM radio 395 is present in the headset 300.

In yet another embodiment, a short-range radio transceiver (for example based on the Bluetooth® radio standard) is included in control box 240. When cable 272 is removed from USB connector 360, the short-range radio is (automatically) activated. Now, audio (or bi-directional voice) may stream between the host device 12 to the headset 16 via a wireless link instead of via the cable 14. Furthermore, in embodiments in which connector 260 is a (micro)USB, cable 272 can still be used for charging the batteries in the headset while the wireless link is maintained.

The invention has been described with reference to particular embodiments. However, it will be readily apparent to those skilled in the art that it is possible to embody the invention in specific forms other than those of the embodiment described above.

For example, in exemplary embodiments described above, various functionalities have been attributed to a "left" ear piece or to a "right" ear piece. However, it will be readily apparent that a wireless headset consistent with one or more inventive principles as set forth herein can be implemented with the roles of the left and right ear pieces (and their associated functions) being reversed. Hence, it is equally valid to describe various embodiments more generally in terms of "first" and "second" ear pieces, wherein the "first" ear piece can refer to either the left ear piece or the right ear piece, and the "second" ear piece consequently refers to the other one of the left and right ear pieces.

The described embodiments are therefore merely illustrative and should not be considered restrictive in any way. The scope of the invention is given by the appended claims, rather than the preceding description, and all variations and equivalents which fall within the range of the claims are intended to be embraced therein.

What is claimed is:

1. A wired headset device comprising:

a first ear piece comprising a first speaker and a first microphone;

a second ear piece comprising a second speaker and a second microphone;

a control box comprising control box circuitry, wherein the control box is separate from both the first and second ear pieces;

a first cable connected at one end to the control box and connected at another end to the first ear piece;

a second cable connected at one end to the control box and connected at another end to the second ear piece; and a connector for connecting the control box to a third cable, wherein the third cable is for connecting the control box to a phone or media player, wherein:

the control box circuitry comprises noise cancellation circuitry for noise cancellation processing of signals provided by the first and second microphones;

the control box circuitry comprises a power management unit;

the first ear piece further comprises a first battery connected to supply power to the power management unit by means of the first cable;

the second ear piece further comprises a second battery connected to supply power to the power management unit by means of the second cable; and the batteries in the first and second ear pieces are electrically connected in parallel.

2. The device of claim 1, wherein the control box comprises a third battery connected to supply power to at least a portion of circuitry within the wired headset device.

3. The device of claim 1, wherein the first ear piece is a left ear piece.

4. The device of claim 1, wherein the control box circuitry comprises an FM radio.

5. The device of claim 4, wherein the first and second cables are configured to be used as an antenna for the FM radio.

6. The device of claim 5, wherein one of the first or second cables is isolated from the control box ground with respect to radiofrequency signals.

7. The device of claim 1, wherein the control box comprises a microphone configured to supply microphone output signals to a host device.

8. The device of claim 1, wherein:

the first cable comprises a first pair of wires coupled to convey power from the first battery to the power management unit;

the first cable comprises a second pair of wires coupled to carry analog audio signals between the first speaker and the control box circuitry; and the first cable comprises a third pair of wires coupled to carry analog audio signals between the first microphone and the control box circuitry.

9. The device of claim 8, wherein:

the second ear piece further comprises a second battery connected to supply power to the power management unit by means of the second cable;

the second cable comprises a first pair of wires coupled to convey power from the second battery to the power management unit;

the second cable comprises a second pair of wires coupled to carry analog audio signals between the second speaker and the control box circuitry; and the second cable comprises a third pair of wires coupled to carry analog audio signals between the second microphone and the control box circuitry.

10. The device of claim 1, wherein:

the first cable comprises two wires for supplying the power from the first battery to the power management unit; and the device comprises circuitry for communicating a first channel of two-channel audio information in digital form from the control box circuitry to circuitry in the first ear piece via the two wires in the first cable.

11. The device of claim 10, wherein:

wherein the second ear piece further comprises a second battery connected to supply power to the power management unit by means of the second cable;

the second cable comprises two wires for supplying the power from the second battery to the power management unit; and the device comprises circuitry for communicating a second channel of the two-channel audio information in digital form from the control box circuitry to circuitry in the second ear piece via the two wires in the second cable.

12. The device of claim 11, wherein:

the first and second channels of the two-channel audio information are time multiplexed when communicated via the first and second cables to the respective first and second ear pieces.

13. The device of claim 1, wherein:

the first microphone is for generating a first microphone signal from sensed acoustic energy;

the second microphone is for generating a second microphone signal from sensed acoustic energy; and the noise cancellation circuitry comprises beam-forming circuitry coupled to receive the first and second microphone signals and adapted to constructively combine components of the first and second microphone signals that are associated with a source of acoustic energy, and to destructively combine all other components of the first and second microphone signals.

14. The device of claim 1, wherein the device comprises a short-range radio in the control box, wherein the short-range radio is for wireless communication between the device and the phone or media player.

15. The device of claim 14, wherein:

the connector is adapted to provide for removable connection to the third cable; and the device comprises circuitry configured to activate the short-range radio in response to the third cable being disconnected from the control box.

16. The device of claim 1, wherein the connector is adapted to provide for removable connection to the third cable.

17. The device of claim 1, wherein:

the first ear piece comprises an ear bud and a disk, wherein the ear bud is adapted to fit inside an ear and the disk is adapted to be located outside the ear when the ear bud is inside the ear;

the first battery is located in the disk; and the speaker is located in the ear bud.

18. The device of claim 1, wherein:

the first ear piece comprises an ear bud and a disk, wherein the ear bud is adapted to fit inside an ear and the disk is adapted to be located outside the ear when the ear bud is inside the ear;

the first battery is located in the disk;

the speaker is located in the disk; and the ear bud comprises a tube for carrying an audio signal from the speaker into an ear canal of the ear.

* * * * *